US006090166A

United States Patent [19]

Girbaud et al.

[11] Patent Number: 6,090,166

[45] Date of Patent: Jul. 18, 2000

[54] PROCESS FOR DYEING A TEXTILE MATERIAL WITH INDIGO USING INDOXYL, AND SYSTEM FOR EXPLOITING THE PROCESS

[76] Inventors: François Girbaud; Marie-Thérèse Bachellerie, both of 2 Ennismore Gardens, London SW7 1NL, United Kingdom

[21] Appl. No.: 09/349,692

[22] Filed: Jul. 8, 1999

[30] Foreign Application Priority Data

Aug. 18, 1998 [EP] European Pat. Off. ..... 98630046

[51] Int. Cl.[7] ..... D06P 1/22; D06B 3/12; D06B 21/00; C09B 7/00; D06M 15/19

[52] U.S. Cl. ..... 8/653; 8/495; 8/653; 8/918; 8/931; 8/151.2; 8/115.6; 68/9; 68/22 R; 68/94; 68/200

[58] Field of Search ..... 8/495, 653, 931, 8/918, 151.2, 115.6; 68/9, 22 R, 94, 200

[56] References Cited

U.S. PATENT DOCUMENTS

| | | |
|---|---|---|
| 2,920,932 | 1/1960 | Barnhill . |
| 3,457,022 | 7/1969 | Fields . |
| 4,118,183 | 10/1978 | Godau et al. . |
| 4,283,198 | 8/1981 | Fletcher . |
| 4,313,235 | 2/1982 | Gotovtseva et al. . |
| 4,416,124 | 11/1983 | Godau . |
| 5,134,789 | 8/1992 | Godau . |
| 5,586,992 | 12/1996 | Schnitzer et al. . |

FOREIGN PATENT DOCUMENTS

| | | |
|---|---|---|
| 0246933 | 11/1987 | European Pat. Off. . |
| 0692042 | 11/1996 | European Pat. Off. . |
| 2544613 | 4/1977 | Germany . |
| 4007504 | 9/1990 | Germany . |
| 4223556 | 1/1994 | Germany . |
| 614339 | 9/1975 | Switzerland . |

*Primary Examiner*—Margaret Einsmann
*Attorney, Agent, or Firm*—Polster, Lieder Woodruff & Lucchesi

[57] ABSTRACT

The invention relates to a process for dyeing a textile fabric with indigo by using indoxyl which comprises the following stages:

a. pre-washing a thread F by passing it thorough a pre-wash system (1) composed of two or more vats (2) containing a pre-wash solution (10,15);

b. subsequently dyeing the thread by passing it through a dyeing system (30) composed of a series of eight vats (35), each containing an indoxyl solution, and, during its passage from one vat (35) to another, the thread undergoes oxidation by exposure to air, the indoxyl converting to indigo which then dyes the thread by impregnation, the oxidation by exposure to air being performed in such a way that, during the passage from the first vat (35) to the eighth in succession, if a value x is given to oxidation between the first vat (35) and the second, the following values will be obtained successively:

oxidation value between 1st and 2nd vats=x oxidation value between 2nd and 3rd vats=2x oxidation value between 3rd and 4th vats=3x oxidation value between 4th and 5th vats=4x oxidation value between 5th and 6th vats=5x oxidation value between 6th and 7th vats=6x oxidation value between 7th and 8th vats=7x oxidation value after 8th vat=8x;

d. sizing the indigo dye onto the thread fibers;

e. drying the thread;

f. collecting the warp thread by winding it onto the spool (72).

16 Claims, 4 Drawing Sheets

PROCESS FOR DYEING A TEXTILE MATERIAL WITH INDIGO USING INDOXYL, AND SYSTEM FOR EXPLOITING THE PROCESS

The present invention relates to a process for dyeing a textile material with indigo using indoxyl, and the system for exploiting the process.

By means of this process, an indigo-dyed textile thread is produced from which a fabric called denim fabric can subsequently be prepared for the production of articles such as blue jeans, for example.

Indigo is one of the oldest known dyes and has been used for centuries to dye textiles such as cotton.

Patent EP-B-0 692 042 describes a process for dyeing a textile fabric containing cellulose using indigo during which an aqueous solution of leuco indigo prepared by catalytic hydrogenation is employed, this latter being converted to its pigmentary form by air oxidation following its uptake into the textile fabric.

Patent U.S. Pat. No. 4,283,198 describes a continuous process for dyeing cellulose fibres with indigo in which the fibres are passed through a series of steeping vats containing a dye liquor comprising leuco indigo, sodium hydrosulfite and sodium hydroxide.

Patent application U.S. Pat. No. 3,457,022 describes a process for dyeing cotton fibres with indigo in which indigo is applied onto the threads at a temperature between 65° C. and 80° C. and indigo is then applied at temperatures below 40° C.

Blue jeans dyed with indigo have the disadvantage of fading on washing. In recent years, there has even existed a fashion to wear faded blue jeans, and the industry developed processes and systems in order to follow this fashion, in which fading of the textile was accentuated and furthered by promoting fading of the warp thread. The method of use of the dye assisted the fading and ageing process. But all fashion is ephemeral and lasts only a certain time.

Patent application EP 98630005.1 describes a dyeing process with indigo during which a denim fabric is produced which is resistant to wear and fading. By means of this process, the indigo penetrates more deeply into the thread. In processes prior to this patent application, the thread contained a white central core and only the external part was dyed with indigo. In the process according to patent EP 98630005.1, the white central core was much more slender.

The object of the present invention is the production of a denim fabric which resists wear and fading and the thread obtained is dyed right through to such an extent that the white central core is practically non-existent and has even disappeared.

By means of the process and system according to the present invention, the complete penetration of the indigo by the thread is attained by completely or virtually eliminating the internal white core and thus eliminating fabric ageing caused by fading due to washing.

Until now, one of the reasons for the failure of indigo to penetrate right through the yarn has been its large molecule:

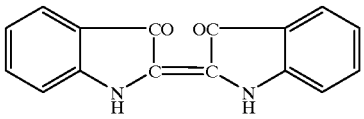

indigo

It is known, however, that the synthesis of indigo is obtained by oxidation of two indoxyl molecules according to the equation:

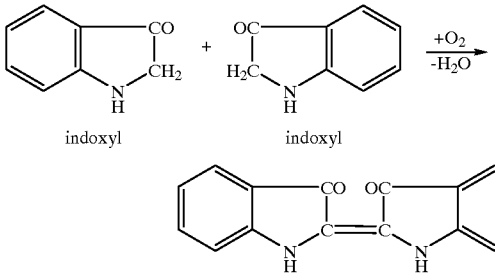

indigo

It is assumed that indoxyl reacts according to its ketonic tautomeric formula. By means of the process according to the present invention, the thread to be dyed is impregnated with indoxyl and the indoxyl is then oxidized in situ to obtain indigo.

Without wishing to be bound by any particular theory, it is assumed that the indoxyl molecule, which is smaller than the indigo molecule, penetrates the thread more deeply, and the disappearance of the white core is thus obtained due to oxidation in situ of indoxyl to give indigo, which will fix onto the thread throughout its thickness.

By means of the process according to the invention, the operations normally carried out for dyeing thread with indigo blue are modified by the inclusion of additional operations, both at the vat stage and the oxidation and preliminary mercerization stages, to assist the absorption and impregnation ability of the thread.

During the oxidation process according to the invention, the first stage consists of very rapid exposures to air at the beginning of the process in the initial dye baths and subsequently the exposure period is progressively increased after each bath in order to aid indoxyl penetration into the thread and achieve oxidation in situ.

The thread is then steamed under specific temperature and pressure conditions, before being washed and re-mercerized.

The second stage of the process consists of forming insulation around the now dyed thread to render it fast to washing, and it is then ready for use. To achieve this, the thread must first be rendered neutral by successive runs through acid baths.

The thread is then completely dried, and the indigo will permanently fixed and will possess the required characteristics. As has been stated above, the thread obtained by the known processes of the art is composed of a white, i.e. non-dyed, central core and an external part impregnated with indigo dye. By means of the process according to the invention, the central core is dyed right through with indigo.

In order that this invention may be better understood, reference is made to the accompanying figures in which.

Figure 1:
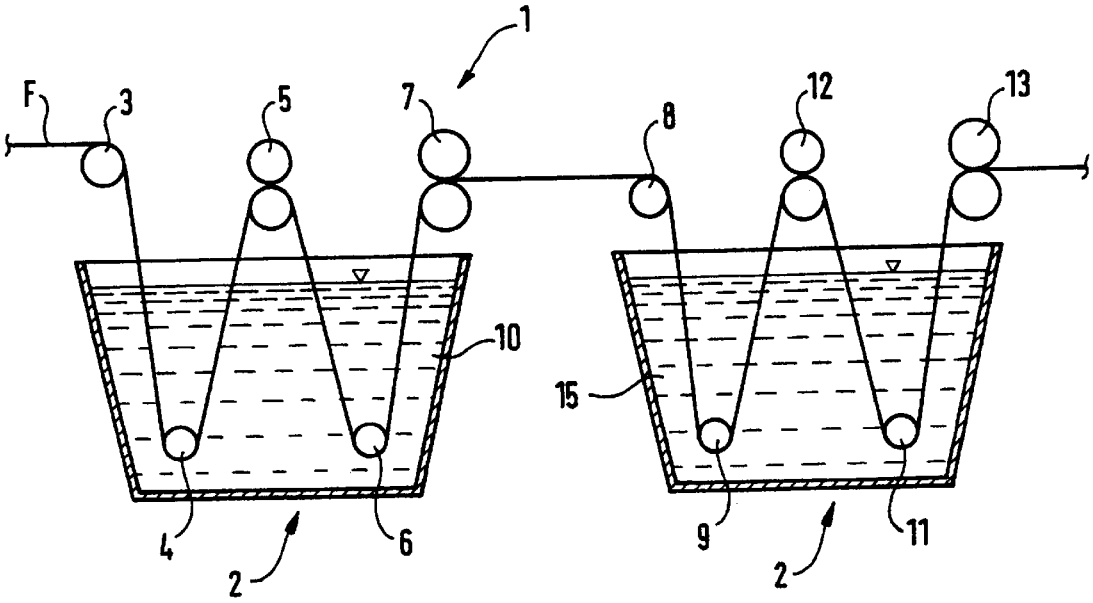
FIG. 1 shows a diagrammatic view of the pre-washing system used during the process according to the invention.

The process according to the invention will now be described by reference to FIGS. 1 to 5 successively. According to this process, firstly a pre-wash stage is carried out by passing the thread F proceeding from the delivery roller on which it is wound through a pre-wash system (1) composed of two or several vats (2) containing a pre-wash solution (10,15). The thread is guided by rollers (3 and 4) into the first vat (2) containing the pre-wash solution and then, on leaving this solution, it passes between two squeeze rollers to remove the excess liquid, and then, guided by roller (6), it is again immersed in the pre-wash solution. On leaving this bath, the thread passes between two squeeze rollers (7). Then, guided by the guide rollers (8) and (9), the thread is immersed in the pre-wash solution (15) contained in the second vat (2). The thread travels through the second vat following an identical course to that followed through the first vat by running successively between the two squeeze rollers (12), under the guide roller (11), then between the squeeze rollers (13).

The pre-wash solution contains an absorbent product such as FINBIL (produced by the Bozzetto Company) (trade description), which is a fatty alcohol phosphoric acid ester derivative. It is used in the aqueous solution at a concentration of 5 to 8 g/litre. This pre-wash bath is used to impregnate the thread to aid subsequent penetration by indoxyl.

Figure 2:
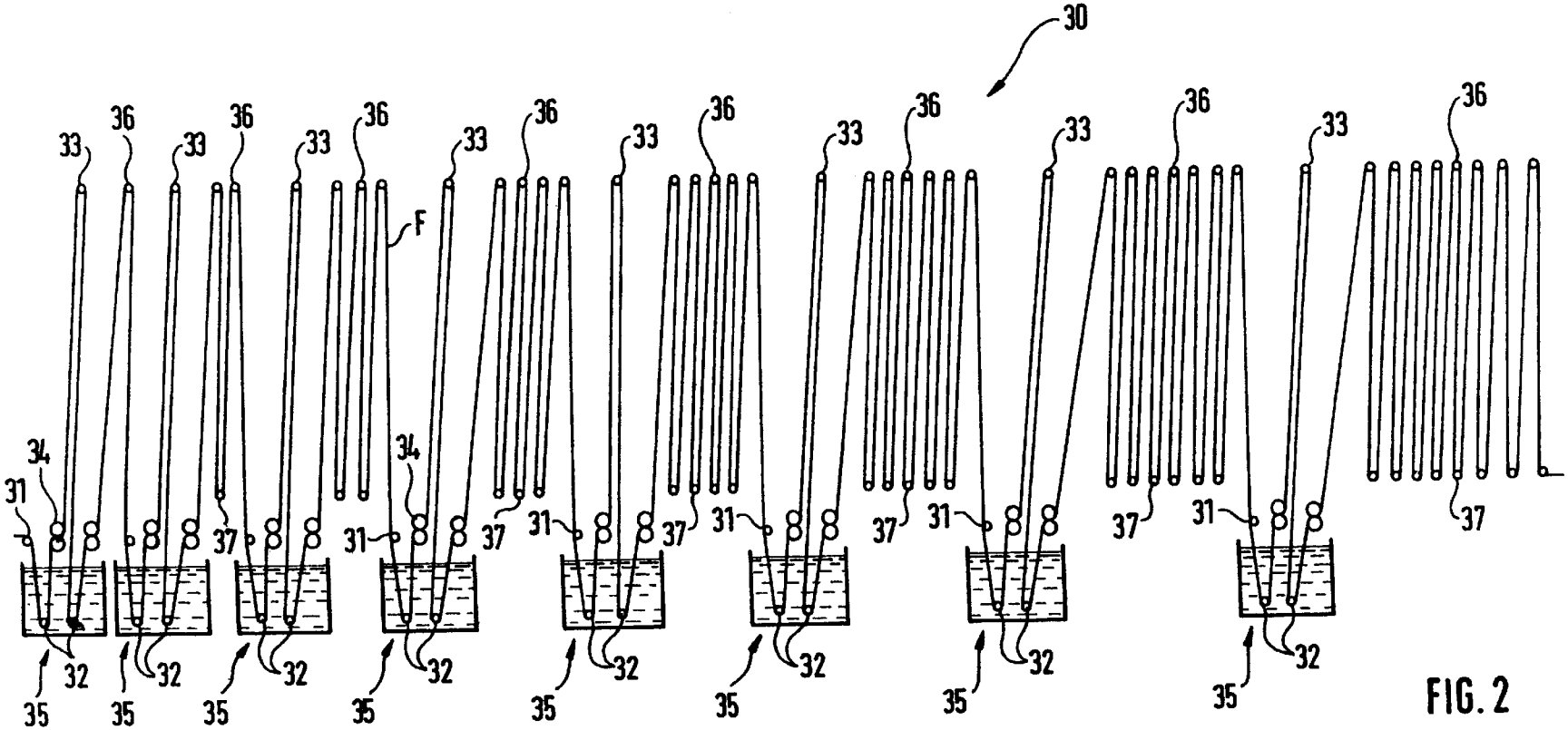
FIG. 2 shows a diagrammatic view of the indoxyl dyeing system used during the process according to the invention.

After this pre-wash stage, the thread reaches the actual dyeing stage, which is carried out in the dyeing system shown in FIG. 2.

The dyeing system (30) is composed of a series of 8 vats (35) containing an indoxyl solution. The thread F proceeding from the pre-wash system is guided by the guide roller (31) into the dye solution contained in the first vat (35), turns round roller (32) and leaves the bath to run between the first squeeze rollers (34) of the first vat (35), turns round roller (33) and returns to the dye solution in the first vat, turns round the second roller (32) of the first vat to then leave the bath, passes between the second set of squeeze rollers (34) of the first vat. Then the thread passes round roller (36). During the journey between the second set of squeeze rollers (34) and roller (36), the impregnated thread is oxidized and indigo is formed which dyes the thread. After turning round roller (36), the thread runs into the dye solution contained in the second vat, in which it follows the same course as in the first vat by means of rollers (31), (32) and (34) of this second vat. On exit from the second vat, the thread no longer turns round one roller (36), as it did on exit from the first vat, but round two rollers (36) and one roller (37) so that the passage exposed to air on leaving the second vat will be twice as long as the passage on leaving the first vat, and oxidation will thus be twice as great. After turning round rollers (36) and (37), the thread enters the third vat, and so forth, until it reaches the eighth vat, and on leaving each vat the thread turns round the rollers (36). It should be noted, as shown in FIG. 2, that between the third and fourth vat there are three rollers (36), between the fourth and the fifth vat there are four rollers (36) and so forth until the exit from the eighth vat, where there are 8 rollers (36). Consequently, the period of exposure to air increases progressively with the passage from the first vat to the eighth, so that if the value x is given to the oxidation process between the first vat and the second, the result will be successively:

oxidation value between 1st and 2nd vats=x
oxidation value between 2nd and 3rd vats=2x
oxidation value between 3rd and 4th vats=3x
oxidation value between 4th and 5th vats=4x
oxidation value between 5th and 6th vats=5x
oxidation value between 6th and 7th vats=6x
oxidation value between 7th and 8th vats=7x
oxidation value after 8th vat=8x The dye baths contain an aqueous solution of indoxyl containing 6 to 8% by weight of pure indoxyl.

The threads pass through the baths at a speed of 20 to 60 m/minute according to the type and quality of the thread.

As indoxyl reacts easily with oxygen in the air, the stability of the indoxyl baths in the vats (35) should be fixed before the solution is applied to the thread. This is achieved by adding to the bath a reducing mixture of sodium hydrosulphite ($Na_2S_2O_4$) and sodium hydroxide (NaOH). At the interface between the bath and the atmospheric air, the reducing bath reacts with the oxygen according to the equation $$Na_2S_2O_4+2NaOH+\tfrac{1}{2}O_2 \rightarrow H_2O+2Na_2SO_3$$

If necessary, if the oxidation period in the open air is too long, a forced air circulation may be applied by means of ventilation systems.

The example shown in FIG. 2 comprises 8 vats, but the operation can obviously be repeated two, three or more times by using two, three or more sets of 8 vats, thus achieving greater indoxyl penetration within the thread.

By means of this dyeing process, a rich, dark indigo coloration of the thread is obtained.

Figure 3:
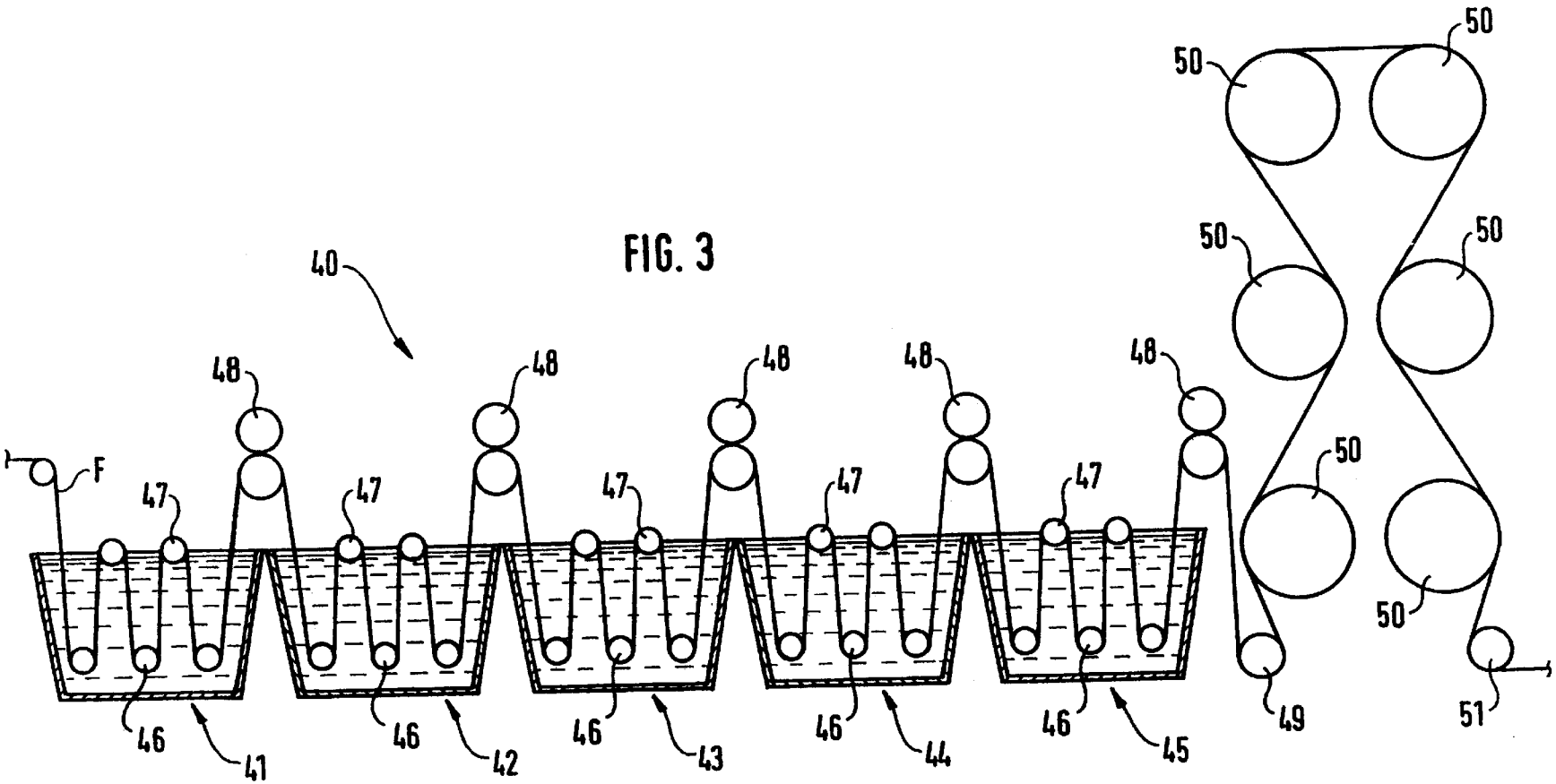
FIG. 3 shows a diagrammatic view of the washing and pre-drying system used during the process according to the invention.

Once the thread has been dyed, it is washed and pre-dried by means of the system (40) shown in FIG. 3. The thread is passed successively through vats (41) to (45), guided by rollers (46), (47) and (48). Vat (41) contains water, and 50% acetic acid ($CH_3$—COOH) is introduced into vats (42), (43) and (44) so that vat (42) contains a 20 cc/l proportion, vat (43) contains 10 cc/l and vat (44) contains 5 cc/l. Vat (45) again contains water, the final pH being between 6 and 7, preferably 6.7.

On leaving vat (45), the thread is pre-dried by turning round rollers (50), as can be seen from FIG. 3.

Figure 4:
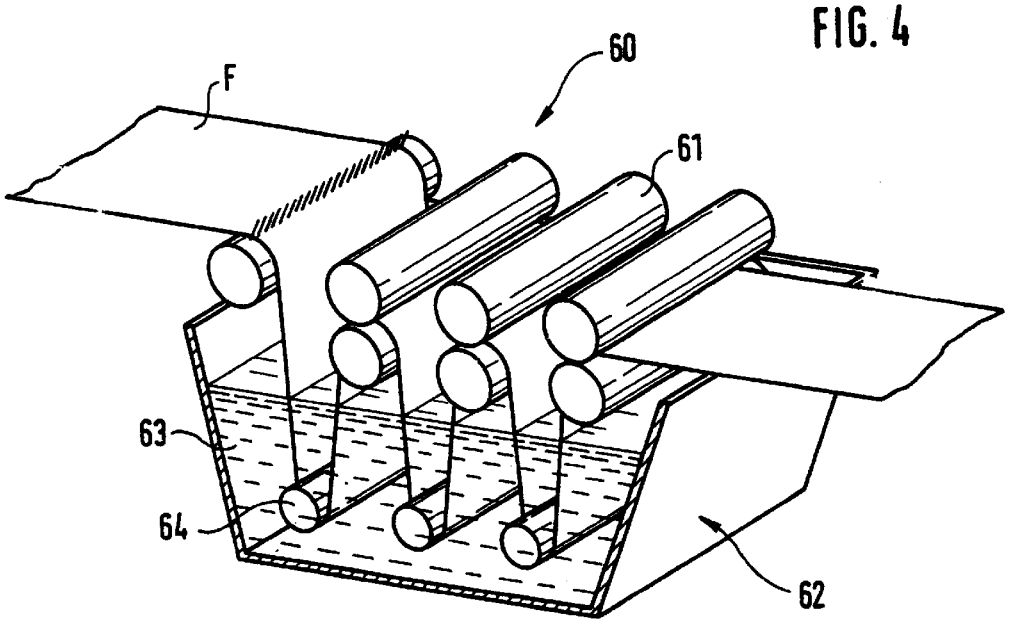
FIG. 4 shows a diagrammatic view of the sizing system used during the process according to the invention.

After washing and pre-drying the thread, it is sized with the indigo dye to increase washing and crocking fastness of the fabric to be subsequently prepared, by passing the thread through a sizing system (60), shown in FIG. 4. The thread passes through a vat (62) containing a blend of resins (63) and is guided through the vat by guide rollers (64) and squeeze rollers (61).

The composition of the resin blend is as follows:

10 to 50 g/l polyalkylamine quaternary salts
10 to 50 g/l fluorocarbon resin
10 to 200 g/l acrylic resin
1 to 20 g/l autocatalysed polysiloxane
10 to 200 g/l polyurethane resin During this sizing operation, a transparent film is formed on the thread fibres which fixes the indigo onto the thread, thereby increasing its washing fastness.

Figure 5:
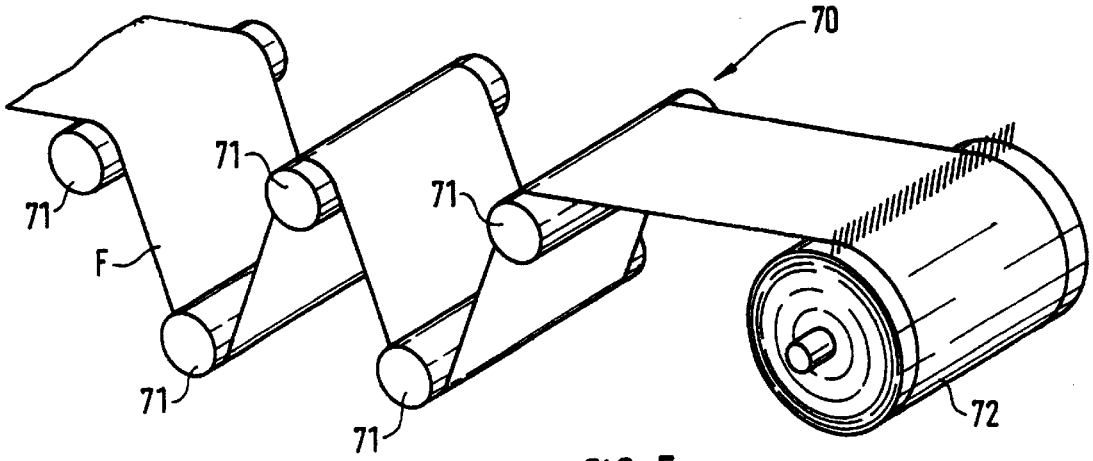
FIG. 5 shows a diagrammatic view of the drying and warp-thread formation system according to the invention.

After this sizing stage, the thread is dried by means of the system (70) shown in FIG. 5, by running the threads round rollers (71). This drying is effected at a temperature between 150–180° C.

Subsequently, the warp thread is wound round the roller (72).

The process according to the invention can be exploited using various types of thread, for example, cotton, cotton and nylon, cotton and polyester, etc.

The process and the system for exploiting the process are the preferred embodiments. It should be noted that modifications can be made, it being understood that these modifications are also within the scope of the following claims.

What is claimed is:

1. A process for dyeing a thread with indigo, characterized in that it comprises the following stages:

a. pre-washing the thread (F) by passing it through a pre-wash system (1) composed of two or more vats (2) containng a pre-wash solution (10,15);

b. subsequent dyeing of the thread by passing it through a dyeing system (30) composed of a series of eight vats (35), each one containing an indoxyl solution, and during the passage from one vat (35) to another, the thread undergoes oxidation by exposure to air, converting the indoxyl to indigo, which then dyes the thread by impregnation, the oxidation by exposure to air being performed in such a way that, during the passage from the first vat (35) to the eighth vat in succession, if a value x is given to the oxidation between the first vat (35) and the second, the following values will be obtained successively:

oxidation value between 1st and 2nd vats=x
oxidation value between 2nd and 3rd vats=2x
oxidation value between 3rd and 4th vats=3x
oxidation value between 4th and 5th vats=4x
oxidation value between 5th and 6th vats=5x
oxidation value between 6th and 7th vats=6x
oxidation value between 7th and 8th vats=7x
oxidation value after 8th vat=8x;

c. washing and pre-drying the thread by passing it through a washing and pre-drying system (40) comprising a series of vats (41, 42, 43, 44 and 45), the first vat (41) containing water, vats (42, 43 and 44) containing acetic acid and vat (45) containing water, so that the pH in the last vat is between 6 and 7, and, at the exit from vat (45), the thread is pre-dried by passing it between rollers (50);

d. sizing the indigo dye onto the thread by passing it through a sizing system (60) comprising a vat (62) containing a resin blend in order to form a transparent film on the thread fibres;

e. drying the thread by passing it through a drying system (70) composed of rollers (71);

f. collecting the thread by winding it onto the spool (72).

2. A process according to claim 1, characterized in that during stage a), a pre-wash solution containing a fatty alcohol phosphoric acid ester derivative is employed.

3. A process according to claim 1, characterized in that the dye liquor in the vats (35) is comprised of an aqueous solution of 6 to 8% by weight of pure indoxyl.

4. A process according to claim 1, characterized in that in stage c), the acetic acid solution in vat (42) is obtained by adding 20 cc/l of 50% acetic to vat (42), the acetic acid solution in vat (43) is obtained by adding 10 cc/l of 50% acetic acid to vat (43) and the acetic acid solution in vat (44) is obtained by adding 5 cc/l of 50% acetic acid to vat (44).

5. A process according to claim 1, characterized in that the resin blend during stage d) comprises a mixture of 10 to 50 g/l polyalkylamine quaternary salts;

10 to 50 g/l fluorocarbon resin;

10 to 200 g/l acrylic resin;

1 to 20 g/l autocatalysed polysiloxane; and 10 to 200 g/l polyatethane resin.

6. A process according to claim 1, characterized in that stage b) may be repeated several times by using 8% dye vats (35), where x is an integer and has a value equal to or greater than 1.

7. A process according to claim 1, characterized in that the threads pass through the dye liquors at a speed of 20 to 60 m/minute.

8. A system for exploiting the dyeing process according to claim 1, characterized in that it comprises;

a) a pre-wash system (1);

b) a dyeing system (30);

c) a washing and pre-drying system (40);

d) a sizing system (60); and e) a drying system (70);

wherein the dyeing system (30) comprises a series of 8 vats (35) containing an indoxyl bath a series of rollers (31, 32, 33, 34, 36 and 37) associated with each vat the rollers (36) being arranged between each vat in such a way that there is a roller (36) between the first and second vats (35), two rollers (36) between the second and third vats, three rollers (36) between the third and fourth vats (35) and so forth until the eighth vat (35) and after this vat there are also eight rollers (36), this arrangement of rollers (36) enabling the exposure period of the tread in the open air to be progressively increased so that this thread is oxidized in such a way that if a value x is given to oxidation between the first vat (35) and the second vat, the following values will be obtained successively;

oxidation value between 1st and 2nd vats=x
oxidation value between 2nd and 3rd vats=2x
oxidation value between 3rd and 4th vats=3x
oxidation value between 4th and 5th vats=4x
oxidation value between 5th and 6th vats=5x
oxidation value between 6th and 7th vats=6x
oxidation value between 7th and 8th vats=7x
oxidation value after 8th vat=8x.

9. A system according to claim 8, characterized in that the pre-wash system comprises:

two or several vats (2) containing a pre-wash solution (10,15), a guide roller (3) to guide the thread into the pre-wash solution (10), a guide roller (4) to guide the thread between two squeeze rollers (5) which guide the tread to a guide roller (6), two squeeze roller (7) to extract the excess liquid, a guide roller (8) guiding the thread into wash liquid (15) in the second vat (2), a guide roller (9) guiding the thread to two squeeze rollers (12), a guide roller (11) leading the thread again into the pre-wash solution(15) and two squeeze rollers (13) which dry the thread on its exit from the second vat (2).

10. A system according to claim 8, characterized in that stage b) may be repeated several times by using 8x dye vats (35), where x is an integer and has a value equal to or greater than 1.

11. A system according to claim 8, characterized in that the washing and pre-drying system (40) comprises a series of vats (41, 42, 43, 44 and 45) and rollers (46, 47 and 48) associated with each vat, the first vat (41) containing water, vats (42, 43 and 44) containing acetic acid and vat (45) containing water so that the pH in the last vat is between 6 and 7, and at the exit from the vat (45) there is series of rollers (50) to dry the thread.

12. A system according to claim 8, characterized in that the sizing system (60) comprises a vat (62) containing a blend of resins.

13. A system according to claim 8, characterized in that during stage a), a pre-wash solution is used containing a fatty alcohol phosphoric acid ester derivative.

14. A system according to claim 8, characterized in that the dye liquor in the vats (35) comprises an aqueous solution of indoxyl containing 6 to 8% by weight of pure indoxyl.

15. A system according to claim 11, characterized in that during stage c), the acetic solution in vat (42) is obtained by adding 20 cc/l of 50% acetic acid to vat (42), the acetic acid solution in vat (43) is obtained by adding 10 cc/l of 50% acetic acid to vat (43) and the acetic acid solution in vat (44) is obtained by adding 5 cc/l of 50% acetic acid to vat (44).

16. A system according to claim 12, characterized in that the resin blend during stage d) comprises a mixture of 10 to 50 g/l polyalkylamine quaternary salt;

10 to 20 g/l fluorocarbon resin;

10 to 200 g/l acrylic resin;

1 to 20 g/l autocatalysed polysiloxane; and 10 to 200 g/l polyurethane resin.

* * * * *

UNITED STATES PATENT AND TRADEMARK OFFICE
CERTIFICATE OF CORRECTION

PATENT NO : 6,090,166

DATED : July 18, 2000

INVENTOR(S) : Francois Girbaud, et al.

It is certified that errors appear in the above-identified patent and that said Letters Patent are hereby corrected as shown below:

In the Abstract:

Before letter "d.", insert the following ---c. washing and pre-drying the thread by passing it through a washing and pre-drying system (40) comprising a series of vats (41, 42, 43, 44 and 45), the first vat (41) containing water, vats (42, 43 and 44) containing acetic acid and vat (45) containing water, so that the pH in the last vat is between 6 and 7, and at the exit from vat (45), the thread is pre-dried by passing it between rollers (50)---;

Col. 6, Line 5
After 8, it reads "%", it should read ---x---.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*